US012084212B2

(12) United States Patent
Kimmerle

(10) Patent No.: US 12,084,212 B2
(45) Date of Patent: Sep. 10, 2024

(54) APPARATUS AND METHOD FOR STRAPPING PACKAGED GOODS

(71) Applicant: ErgoPack Deutschland GmbH, Lauingen (DE)

(72) Inventor: Andreas Kimmerle, Hoechstaedt (DE)

(73) Assignee: ErgoPack Deutschland GmbH, Lauingen (DE)

( * ) Notice: Subject to any disclaimer, the term of this patent is extended or adjusted under 35 U.S.C. 154(b) by 275 days.

(21) Appl. No.: 17/624,185

(22) PCT Filed: Jul. 29, 2019

(86) PCT No.: PCT/EP2019/070392
§ 371 (c)(1),
(2) Date: Dec. 30, 2021

(87) PCT Pub. No.: WO2021/013365
PCT Pub. Date: Jan. 28, 2021

(65) Prior Publication Data

US 2022/0348366 A1 Nov. 3, 2022

(30) Foreign Application Priority Data

Jul. 22, 2019 (DE) ..... 102019119702.3

(51) Int. Cl.
*B65B 13/08* (2006.01)
*B65B 13/04* (2006.01)
*B65B 57/04* (2006.01)

(52) U.S. Cl.
CPC ..... *B65B 13/08* (2013.01); *B65B 57/04* (2013.01)

(58) Field of Classification Search
CPC ..... B65B 13/04; B65B 13/08; B65B 57/04
See application file for complete search history.

(56) References Cited

U.S. PATENT DOCUMENTS 3,213,781 A * 10/1965 Collins ..... B65B 13/186 100/25
3,613,557 A * 10/1971 Coleman ..... B65B 13/06 100/26

(Continued)

FOREIGN PATENT DOCUMENTS

DE 29908906 U1 9/1999
DE 10315530 A1 10/2004

(Continued)

OTHER PUBLICATIONS

English translate (EP2712817A1), retrieved date Jan. 20, 2024.*

*Primary Examiner* — Mohammed S. Alawadi
(74) *Attorney, Agent, or Firm* — Koffsky Schwalb LLC

(57) ABSTRACT

The invention relates to an apparatus (1) for strapping packaged goods (2) with at least one strapping band (4), comprising a band guiding means (5) for guiding the strapping band (4), a conveying device (7) for extending and retracting the band guiding means (5), a guide carriage (11) which can be extended together with the band guiding means (5) by a target extension length as far as a diversion point, a length limiting band (21) which is connected to the guide carriage (11) and can be extended with the guide carriage (11), and an adjusting device (24) for adjusting the target extension length of the guide carriage (11) to the diversion point. The guide carriage (11) has a deflection unit (12) which can divert the band guiding means (5) at the diversion point. According to the invention, the adjusting device (24) is designed to determine an actual extension length of the guide carriage (11) and, according to a target extension length of the guide carriage (11), to control a fixing device (28) which stops the extension movement of the length limiting band (21).

17 Claims, 6 Drawing Sheets

(56) References Cited

U.S. PATENT DOCUMENTS

| | | | | |
|---|---|---|---|---|
| 6,516,592 | B1 * | 2/2003 | Kimmerle | B65B 13/04 53/589 |
| 7,073,430 | B2 | 7/2006 | Kimmerle | |

FOREIGN PATENT DOCUMENTS

| | | | | |
|---|---|---|---|---|
| DE | 102010029992 | A1 | 12/2011 | |
| DE | 102012217805 | A1 | 4/2014 | |
| EP | 1053941 | B1 | 11/2002 | |
| EP | 2712817 | A1 * | 4/2014 | B65B 13/06 |
| EP | 3466820 | A1 | 4/2019 | |

* cited by examiner

APPARATUS AND METHOD FOR STRAPPING PACKAGED GOODS

The invention relates to an apparatus for strapping packaged goods with at least one strapping band, comprising a band guiding means for guiding the strapping band, a conveying installation for deploying and retracting the band guiding means, a guide carriage which conjointly with the band guiding means by a nominal deployment length is deployable up to a deflection point, a length-limitation band which is connected to the guide carriage and extractable by the guide carriage, and an adjustment installation for adjusting the nominal deployment length of the guide carriage up to the deflection point, wherein the guide carriage has a deflection unit which is capable of deflecting the band guiding means at the deflection point.

The invention furthermore relates to a method for strapping packaged goods with at least one strapping band, whereby the strapping band is established on a band guiding means; whereby the band guiding means is deployed by a conveying installation; whereby a guide carriage, releasably connected to the band guiding means, conjointly with the band guiding means is deployed up to a deflection point; whereby a length-limitation band established on the guide carriage is extracted by the guide carriage; whereby the nominal deployment length of the guide carriage up to the deflection point is adjusted in that the extractable length of the length-limitation band is adjusted.

An apparatus of the generic type is known from EP 1 053 941 B1. In terms of further known apparatuses reference is furthermore made to DE 10 2012 217 805 A1 DE 103 15 530 A1 and DE 10 2010 029 992 A1.

Packaged goods, in particular items to be transported or to be stored, for example in the form of parcels, are generally fastened on pallets with a packaging band which hereunder is referred to as a strapping band, so as to ensure a safe transportation without damage, or a corresponding storage, of the items.

When strapping packaged goods, in particular piece goods, placed on pallets with strapping bands, it is necessary for the strapping band to be guided through a gap between the packaged goods and the floor on which the packaged goods and the associated pallet are placed. Since the strapping bands typically display a behavior in the manner of a rope, that is to say are not stiff, the guiding of said strapping bands is often problematic, in particular in the case of comparatively long pallets. Accordingly, strapping in the case of comparatively large packaged goods, for example in the case of parcels or piece goods, is possible only with auxiliary means.

Known from the prior art, as described in EP 1 053 941 B1, is therefore an apparatus for strapping or wrapping a palletized load, said apparatus having a band guiding means and at least one clamping installation which for clamping a leading portion of the strapping band is disposed at the front end of the band guiding means. The band guiding means here is configured as a chain with a rigid spine, a guide carriage being releasably attached to the front end of said chain. The carriage guides the rigid-spine chain and the strapping band attached thereto along the floor and below the pallet. The carriage here can compensate for any minor unevenness of the surface, such as the transverse timbers of the pallets.

So that the user does not have to laboriously pick up the strapping band guided through from the floor, the carriage has a deflection unit for the rigid-spine chain.

The carriage is configured so as to be releasable from the rigid-spine chain and, conjointly with the chain, travels back a distance along the floor that is predefined by a length-limitation band.

At a predefined position (deflection point) the carriage is retained by the length-limitation band and separated from the rigid-spine chain that in an advancing movement is further deployed. The rigid-spine chain by the deflection unit of the carriage is deflected by preferably approximately 90 degrees and thus moved upward in an almost vertical manner. Tilting of the band guide configured as a chain is prevented in that the chain is configured as a rigid-spine chain and could thus tilt only in the direction toward the item to be packed. Tilting in the direction toward the item to be packed is suppressed in that the strapping band within the chain is disposed such that said strapping band keeps the rigid-spine chain tensioned during the deployment movement. This tension is released only once the deployment movement is briefly interrupted, and the rigid-spine chain by virtue of the dead weight thereof tilts in the desired manner onto the item to be packed and, after the deployment movement has continued, in an approximately horizontal path on the upper side of the item to be packed can be fed in the direction toward the user.

Once the user has retrieved the strapping band, or after the strapping procedure has been completed, the rigid-spine chain can be retracted again, wherein said chain in the retraction movement thereof entrains the deployed carriage again and is connected to the latter in the entrainment movement.

The apparatus known from the prior art has proven successful in practice and enables packaged goods, in particular packaged goods disposed on pallets, to be strapped in a simple and rapid manner almost independently of the height of the packaged goods, without the operator having to bend over to this end.

The apparatus for strapping a palletized load known from EP 1 053 941 B1 is robust, not susceptible to defects and simple to operate, which has proven particularly relevant to the user in terms of the daily application.

One of the important features of the apparatus for strapping known from the prior art is the length-limitation band already mentioned above. A front end of the length-limitation band is established on the guide carriage and is thus extracted by the guide carriage. By way of an adjustment installation the user can adjust how far the length-limitation band and thus the guide carriage can be deployed. The deflection point can be defined as a result. Said deflection point is generally chosen in such a manner that the guide carriage can be guided below the packaged goods and the guide carriage moves out from below the pallet again on that side that faces away from the entry side. Once the deflection point, or a nominal deployment length, has been reached, the band guiding means is then deflected by the deflection unit, in particular aligned in an upward manner so as to be vertical in relation to the floor.

According to EP 1 053 941 B1 it is provided that the extractable length of the length-limitation band is delimited by a detent that is configured on the end of the length-limitation band and by an adjustable counter detent, preferably a stud or a bracket, which is attached to the housing of the apparatus. The adjustable counter detent is positioned in such a manner that the latter is situated in the displacement path of the detent of the length-limitation band. The length by which the length-limitation band can be deployed is varied according to the position at which the stud is inserted into the housing of the apparatus. To this end, a pitch of 20 cm is provided in the prior art. A smaller pitch cannot be readily implemented in practice, because a stud cannot be inserted at all locations in the displacement path of the detent of the length-limitation band due to the construction mode.

A further disadvantage of the solution known from the prior art lies in that the detent configured on the length-limitation band impacts the stud at the chosen, ideally high, deployment speed, and the apparatus is mechanically stressed as a result.

In the prior art, compromise has to be made in terms of the speed at which the conveying installation deploys the band guiding means and thus the guide carriage. In order for a rapid strapping procedure to be able to be implemented, a high deployment speed is desirable. The latter however leads to a hard impact and to the risk of the apparatus being damaged. The deployment movement of the guide carriage at a high deployment speed is terminated in a correspondingly abrupt manner. This leads to corresponding noises, on the one hand, and to the deflection unit of the guide carriage being abruptly or rigorously deflected, on the other hand. As is described in EP 1 053 941 B1, the deflection unit, by virtue of the corresponding disposal of the pivot axle that connects the deflection unit to a thrust part of the guide part, is deflected in an upward manner (preferably by 90 degrees) when the band guiding means is further deployed, the guide carriage however being stopped in terms of the movement of the latter.

In order for the impact arising when stopping the guide carriage to be damped, it is conceivable for the detent of the length-limitation band and/or the stud to be damped. It is furthermore conceivable for the gear wheel that drives the band guiding means to also be damped in order to reduce stress on the gear mechanism of the conveying installation during the impact.

Higher deployment speeds can be implemented as a result of these measures; nevertheless, it would be desirable for the speed to be further increased and for the stress on the apparatus upon reaching the deflection point to be reduced.

The present invention is based on the object of further improving the apparatuses for strapping known from the prior art, in particular with a view to achieving an ideally high speed when strapping and an ideally minor stress on the apparatus.

The present invention is furthermore based on the object of further improving the methods for strapping known from the prior art, in particular with a view to being able to realize an ideally high speed when strapping with at the same time minor stress on the parts of the apparatus.

The apparatus according to the invention for strapping packaged goods with at least one strapping band has a band guiding means for guiding the strapping band, a conveying installation for deploying and retracting the band guiding means, a guide carriage which conjointly with the band guiding means by a nominal deployment length is deployable up to a deflection point, a length-limitation band which is connected to the guide carriage and extractable by the guide carriage, and an adjustment installation for adjusting the nominal deployment length of the guide carriage up to the deflection point. The guide carriage here has a deflection unit which is capable of deflecting the band guiding means at the deflection point.

According to the invention, the adjustment installation is specified for determining an actual deployment length of the guide carriage and, as a function of the nominal deployment length of the guide carriage, for controlling a fixing installation which stops the extraction movement of the length-limitation band.

Various advantages are derived as a result of the adjustment installation according to the invention determining an actual deployment length of the guide carriage.

The determination of the actual deployment length of the guide carriage enables a fixing installation to be used, said fixing installation by the adjustment installation being actuated in a targeted manner such that the length-limitation band is stopped when the guide carriage has reached the nominal deployment length, or the deflection point. In the prior art, the detent at the end of the length-limitation band, in conjunction with the adjustable pin, has assumed the function of establishing the extraction length ("adjustment installation") as well as the function of stopping the extraction movement of the length-limitation band ("fixing installation"). As a result of the functions henceforth being able to be separated, i.e. a nominal deployment length being adjusted and an actual deployment length being determined by the adjustment installation, while the fixing installation handles the stopping of the extraction movement, both installations can be configured in a manner optimized for handling the respective task.

The solution according to the invention also enables the fixing installation to be configured in particular on a fixed point of the apparatus, or of the housing of the apparatus. It is not necessary that the fixing installation for adjusting the nominal deployment length is established at different positions of the housing.

The determination of the actual deployment length of the guide carriage by the adjustment installation enables the deployment speed of the band guiding means to be optimized in a particularly advantageous manner. Once it is known as a result of the determination of the actual deployment length of the guide carriage when the guide carriage will reach the nominal deployment length, or the deflection point, the deployment speed of the band guiding means can be reduced in the last portion of the nominal deployment length, or prior to reaching, preferably just prior to reaching, the nominal deployment length, or the deflection point. Additionally or alternatively thereto, the deployment speed of the band guiding means can furthermore be increased upon reaching the deflection point, or once the deflection unit has deflected the band guiding means.

As a result of this measure, the strapping process can be significantly accelerated and it can simultaneously be ensured that the apparatus when reaching the deflection point, by virtue of the deployment speed of the band guiding means that is reduced in this instance, is stressed to a lesser extent, or only to a minor extent. The generation of noise which has been annoying in the past is also reduced as a result. This can advantageously also lead to damping of the gear wheel being able to be dispensed with, said gear wheel preferably driving the band guiding means. As a result, the gear wheel is easier to produce, on the one hand, and the engagement of the gear wheel in the band guiding means can take place in a more accurate or precise manner by virtue of the damping mechanism being dispensed with, on the other hand.

It is advantageous for a control installation to be provided, said control installation being specified for actuating the conveying installation in such a manner that the deployment speed of the band guiding means in a last portion of the nominal deployment length of the guide carriage prior to reaching the deflection point is reduced in comparison to a deployment speed prior to the last portion of the nominal deployment length and/or that the deployment speed of the band guiding means upon reaching the deflection point is increased in comparison to the deployment speed of the band guiding means in the last portion of the nominal deployment length of the guide carriage prior to reaching the deflection point.

Controlling in this way the deployment speed by a control installation which to this end preferably accesses the data of the adjustment installation, in particular the actual deployment length, has proven particularly successful.

The determination of the actual deployment length of the guide carriage by the adjustment installation can take place by direct or indirect measuring. For example, it is possible for the deployment length of the length-limitation band to be measured and for the actual deployment length of the guide carriage to be determined therefrom. It is furthermore also possible for the deployment length of the band guiding means to be measured directly or indirectly, and for the actual deployment length of the guide carriage then to be determined therefrom.

Furthermore alternatively, the actual deployment length of the guide carriage per se can also be directly determined or measured.

It is advantageous for the conveying installation to comprise an electric motor, and for the adjustment installation to determine the actual deployment length of the guide carriage electronically by means of the revolutions of the electric motor.

A determination of the actual deployment length of the guide carriage by detecting or measuring the revolutions of the electric motor which preferably drives the band guiding means so as to deploy and retract the latter has proven to be particularly suitable. The term "detecting or measuring the revolutions of the electric motor" may also include the detection or measurement of partial revolutions of the electric motor.

It is advantageous for the electric motor to comprise an incremental encoder.

The determination of the actual deployment length of the guide carriage by means of the revolutions of the electric motor, or the data of the electric motor, while using an incremental encoder has proven to be particularly suitable.

According to the invention, the adjustment installation can be specified in such a manner that said adjustment installation compares the actual deployment length, the latter preferably having been detected by way of the revolutions of the electric motor, in particular by an incremental encoder, with the nominal deployment length and correspondingly actuates the fixing installation.

The adjustment of the nominal deployment length of the carriage guide can preferably take place electronically by way of a corresponding input panel of the adjustment installation, the latter potentially being configured as part of the control installation.

According to the invention, it can be provided that the adjustment installation is specified for actuating the conveying installation, upon switching on and/or if required, in such a manner that the conveying installation repositions the guide carriage to a reference position.

As a result of the adjustment installation actuating the conveying installation, upon switching on and/or if required, in such a manner that the conveying installation repositions the guide carriage to a reference position, it can be ensured in a simple manner that the measurement of the actual deployment length of the guide carriage takes place without error. According to the invention, it can be provided here that the adjustment installation actuates the conveying installation in such a manner that the guide carriage first is returned or retracted up to a detent, and subsequently is deployed again up to a defined reference position.

In this way, an incremental encoder of an electric motor can also be calibrated in a simple manner.

It can be provided that the fixing installation is fixed so as to be stationary on the apparatus according to the invention, or on a housing of the apparatus according to the invention, and the length-limitation band, or an installation that is connected to the length-limitation band and in this context is considered to be part of the length-limitation band, possesses correspondingly configured detent elements into which the fixing installation then engages if required, according to the parameters of the nominal deployment length and the determined actual deployment length.

It is advantageous for the fixing installation for fixing the length-limitation band to be configured for acting in a form-fitting and/or force-fitting manner on the length-limitation band.

A configuration of the fixing installation in such a manner that the latter acts in a form-fitting and/or force-fitting manner on the length-limitation band in order for the extraction movement of the length-limitation band to be stopped has proven to be particularly suitable.

According to the invention, it can furthermore be provided that the length-limitation band has detent elements disposed in succession in the longitudinal direction of the length-limitation band.

A design embodiment of this type has proven to be particularly suitable, in particular in order for the fixing installation to be configured so as to be stationary on the apparatus, or the housing, and to nevertheless be able to adjust different nominal deployment lengths of the guide carriage in a simple manner.

According to the invention, it can furthermore be provided that the detent elements are disposed at a regular pitch at least along one portion of the length-limitation band.

It has proven advantageous for the detent elements to be disposed at a regular pitch. A pitch of 2 to 20 cm, preferably 5 to 15 cm, furthermore preferably 10 cm +/−2 cm, and most preferably of 10 cm, can preferably be chosen here. The input of the nominal deployment length here can preferably take place by way of a corresponding operator panel, wherein the adjustable nominal deployment lengths are particularly preferably predefined in the operator panel.

It can be advantageous for the adjustment installation to be specified in such a manner, in particular when the fixing installation is to act in a form-fitting manner on the length-limitation band, or the detent elements of the length-limitation band, that said adjustment installation actuates the fixing installation already before the guide carriage has reached the nominal deployment length, in particular in such a manner that the fixing installation is actuated once the detent element has passed that fixing installation that leads the detent element of the length-limitation band by way of which the form-fitting connection is to be established.

It is ensured as a result of this measure that the fixing installation engages in a form-fitting manner in the length-limitation band or interacts with the chosen detent element of the length-limitation band, independently of the chosen deployment speed.

According to the invention, it can furthermore be provided that the detent elements are configured as recesses in the length-limitation band and/or as protrusions.

The configuration of the detent elements as recesses and/or as protrusions in the length-limitation band has proven particularly suitable. It is particularly advantageous for the recesses in the length-limitation band to be configured as slots, or as rectangular recesses. It can in particular be provided here that the recesses have a rectangular shape in which the two longer sides of the rectangle extend in the longitudinal direction of the length-limitation band such that the main axis of the rectangular recesses extends parallel to the longitudinal axis of the length-limitation band, as a result of which the fixing installation can engage into the recesses in a particularly advantageous manner.

The length-limitation band can preferably be configured as a plastics-material band.

It is advantageous for the fixing installation to have an actuating unit which, for limiting the extraction movement of the length-limitation band, brings a fixing element to engage in a form-fitting manner with one of the detent elements of the length-limitation band.

A design embodiment of this type has proven particularly suitable in order to reliably ensure that the extraction movement of the length-limitation band is stopped.

According to the invention, it is preferably provided that the fixing installation moves the fixing element in such a manner that the fixing element is situated in the displacement path, i.e. the extraction path, of the chosen detent element of the length-limitation band.

It is advantageous for the fixing element to interact with a damping element so as to stop in a damped manner an extraction movement of the length-limitation band.

Alternatively or additionally to it being provided that the control installation by virtue of the data of the adjustment installation is controlled in such a manner that the deployment speed of the band guiding means is reduced once the deflection point has been reached, it can be advantageous for the fixing element to be configured in a damped manner so that the forces arising, or the impact resulting from the engagement of the fixing element in the detent elements, are/is damped or reduced.

It can particularly advantageously be provided that the damping element is configured as a spring or as an elastic damping element, for example as a rubber element. The damping element can bear on a front side of the fixing element that in the deployment direction of the band guiding means lies at the front, so that the fixing element is damped when the latter by the detent element of the length-limitation band in which the fixing element engages is impinged with a corresponding force in the deployment direction.

According to the invention it can furthermore be provided that the adjustment installation is specified for detecting the position of the fixing element and/or of the actuating unit.

As a result of the adjustment installation detecting the position of the fixing element and/or the position of the actuating unit, the user can advantageously establish whether the length-limitation band and thus also the guide carriage is locked or freely movable. The adjustment installation here preferably also detects an (undefined) position of the fixing element and/or of the actuating unit, said (undefined) position being situated between the unlocked and the locked position, in particular when the actuating unit, controlled by the adjustment installation, intends to fix the length-limitation band by the fixing element but the length-limitation band is not yet situated in a position in which the fixing element can engage in a detent element, for example a recess.

It is preferably provided that the fixing element is pretensioned in the direction toward the length-limitation band. This design embodiment is particularly suitable when the detent elements in the length-limitation band are configured as recesses. In this case, the fixing element can then invade the recesses in a particularly advantageous manner. When the actuating installation already actuates the fixing element in the direction toward the length-limitation band, or the detent element of the latter, before the detent element of the length-limitation band is correspondingly positioned, the fixing element by virtue of the pretension by the length-limitation band can be pushed back in a direction facing away from the length-limitation band, or run so as to chafe along the length-limitation band until the corresponding detent element is in position such that the fixing element, facilitated by the pretension, can correspondingly invade the recess.

It is advantageous for the fixing element and/or the actuating unit to be configured in such a manner that the fixing element in the non-energized state of the actuating unit is locked to one of the detent elements by a spring force.

As a result of a design embodiment of this type it is ensured that the length-limitation band, or the guide carriage, is not freely movable in the non-energized state.

According to the invention, it can furthermore be provided that the actuating unit is configured as a lifting magnet and/or the fixing element is configured as a latch.

It has proven advantageous for the actuating installation to be configured as a lifting magnet.

The fixing element can preferably be disposed in a receptacle which is established in an articulated or pivotable manner such that the receptacle conjointly with the fixing element can be moved, for example lifted and lowered, by the lifting magnet.

The damping element here can preferably also be disposed in the receptacle, said damping element interacting with the fixing element in such a manner that an extraction movement of the length-limitation band is stopped in a damped manner when the fixing element is brought to engage in a form-fitting manner with one of the detent elements of the length-limitation band, in particular a recess.

As already described, the fixing element is preferably pretensioned in the direction toward the length-limitation band by way of a resilient design embodiment or an elastic element. A design embodiment of this type can in particular be implemented by a suitable positioning of the fixing element in the receptacle as well as by a spring element or an elastic element which acts on the fixing element on that side that faces away from the length-limitation band.

It is advantageous for the fixing element to be configured as a latch or a detent cam. The latch or the detent cam here can be damped by a damping element as described, and furthermore be pretensioned in the direction toward the length-limitation band and preferably be disposed in a receptacle.

It is advantageous for the band guiding means to be configured as a guide chain and for the conveying installation to have at least one gear wheel which, for retracting and deploying the guide chain, engages in the guide chain.

An embodiment of the band guiding means as a guide chain, in particular as a rigid-spine guide chain, has proven particularly successful. Reference to this end is made to the description of EP 1 053 941 B1. The gear wheel which is preferably provided and for retracting and deploying the guide chain engages in the guide chain is preferably configured without damping elements. Damping elements can however be provided in principle. The gear wheel is preferably designed in such a manner that the latter engages in the guide chain ideally with minor tolerances so as to enable the guide chain to be retracted and deployed with as little play as possible. The guide chain can preferably comprise pins or transverse webs that run transversely to the advancing direction, the gear wheel correspondingly engaging in said pins or transverse webs.

The method according to the invention for strapping packaged goods with at least one strapping band provides that the strapping band is established on a band guiding means; whereby the band guiding means is deployed by a conveying installation; whereby a guide carriage, releasably connected to the band guiding means, conjointly with the band guiding means is guided below the packaged goods and deployed up to a deflection point; whereby a length-limitation band established on the guide carriage is extracted by the guide carriage; whereby a nominal deployment length of the guide carriage up to the deflection point is adjusted in that the extractable length of the length-limitation band is adjusted.

According to the invention it is provided here that an actual deployment length of the guide carriage is determined during the deployment of the guide carriage; whereby the extraction movement of the length-limitation band is stopped upon reaching the nominal deployment length of the guide carriage; whereby a deployment speed of the band guiding means in a last portion of the nominal deployment length of the guide carriage prior to reaching the deflection point is reduced in comparison to a deployment speed prior to reaching the last portion of the nominal deployment length, and/or that the deployment speed of the band guiding means upon reaching the deflection point is increased in comparison to the deployment speed of the band guiding means in the last portion of the nominal deployment length of the guide carriage.

As a result of the actual deployment length of the guide carriage being determined, the extraction movement of the length-limitation band can be stopped in a targeted manner when the nominal deployment length of the guide carriage is reached. As a result of the knowledge pertaining to the actual deployment length, the deployment speed of the band guiding means can moreover be advantageously controlled, as has already been described, so as to implement a high strapping speed, on the one hand, and to be able to reduce the mechanical stress at the deflection point, on the other hand.

Features which have already been described in the context of the apparatus according to the invention can of course also be advantageously implemented with a view to the method according to the invention, and vice versa. Furthermore, advantages which have already been mentioned in the context of the apparatus according to the invention can also be understood to relate to the method according to the invention, and vice versa.

The invention furthermore relates to a control installation for controlling the deployment speed in the method according to the invention.

A control installation for controlling the deployment speed, in particular in such a manner that the deployment speed of the band guiding means in a last portion of the nominal deployment length of the guide carriage prior to reaching the deflection point is reduced in comparison to a deployment speed prior to the last portion of the nominal deployment length, and/or that the deployment speed of the band guiding means upon reaching the deflection point is increased in comparison to the deployment speed of the band guiding means in the last portion of the nominal deployment length of the guide carriage prior to reaching the deflection point, is particularly suitable.

The invention furthermore relates to a computer program product having program code means for carrying out the method according to the invention when the program is executed on a control installation of an apparatus for strapping packaged goods.

The figures show in each case preferred exemplary embodiments in which individual features of the present invention are illustrated when combined with one another. The features of one exemplary embodiment may also be implemented independently of the other features of the same exemplary embodiment and can accordingly be combined by a person skilled in the art with features of other exemplary embodiments so as to form further expedient combinations.

Figure 1:
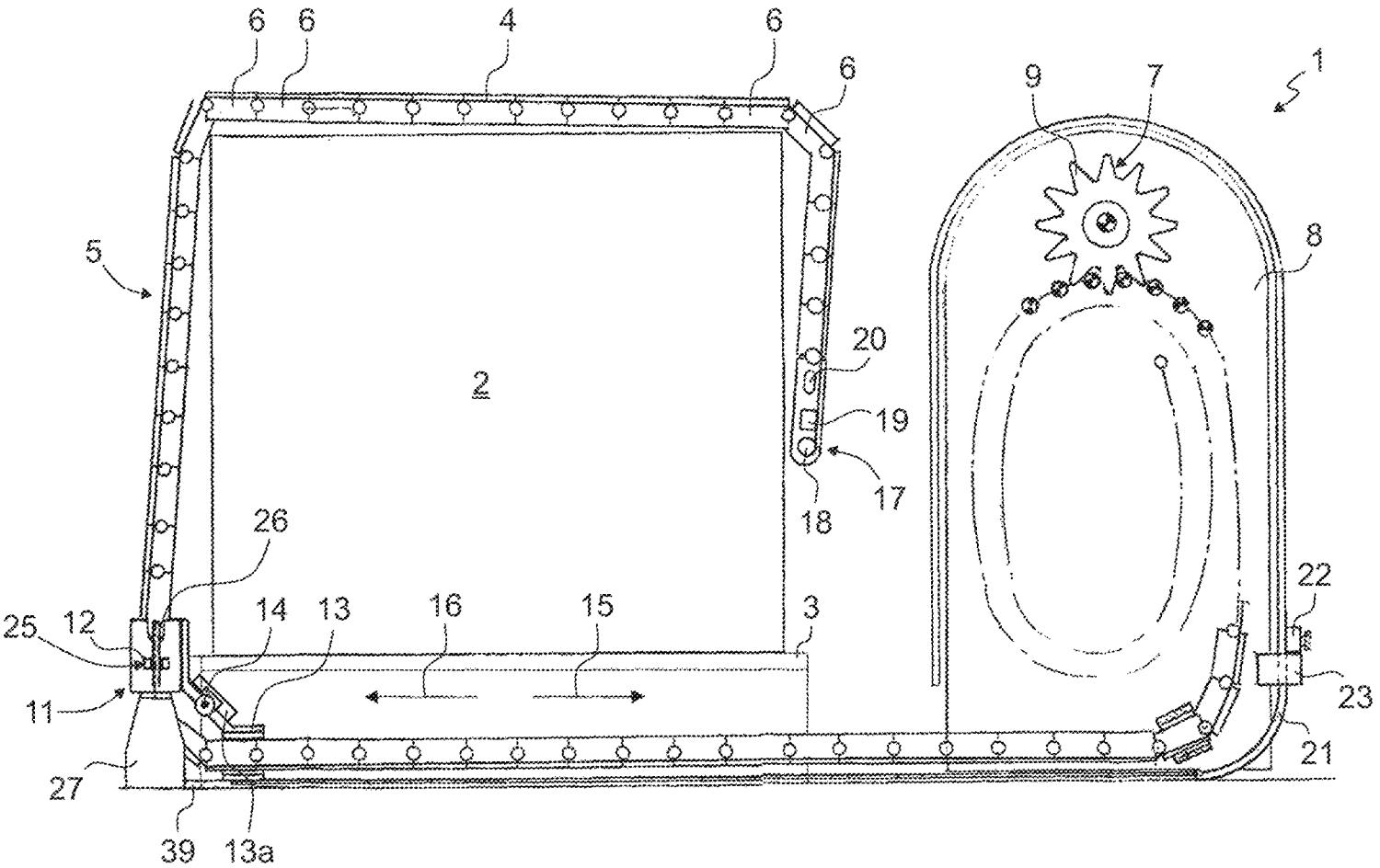
FIG. 1 shows an apparatus for strapping, as is known from the prior art.

An apparatus for strapping, known from the prior art, is shown in FIG. 1. A general functional mode of such an apparatus for strapping will be described hereunder by means of this FIG. 1. Reference to this end is also made to EP 1 053 941 B1.

Figure 2:
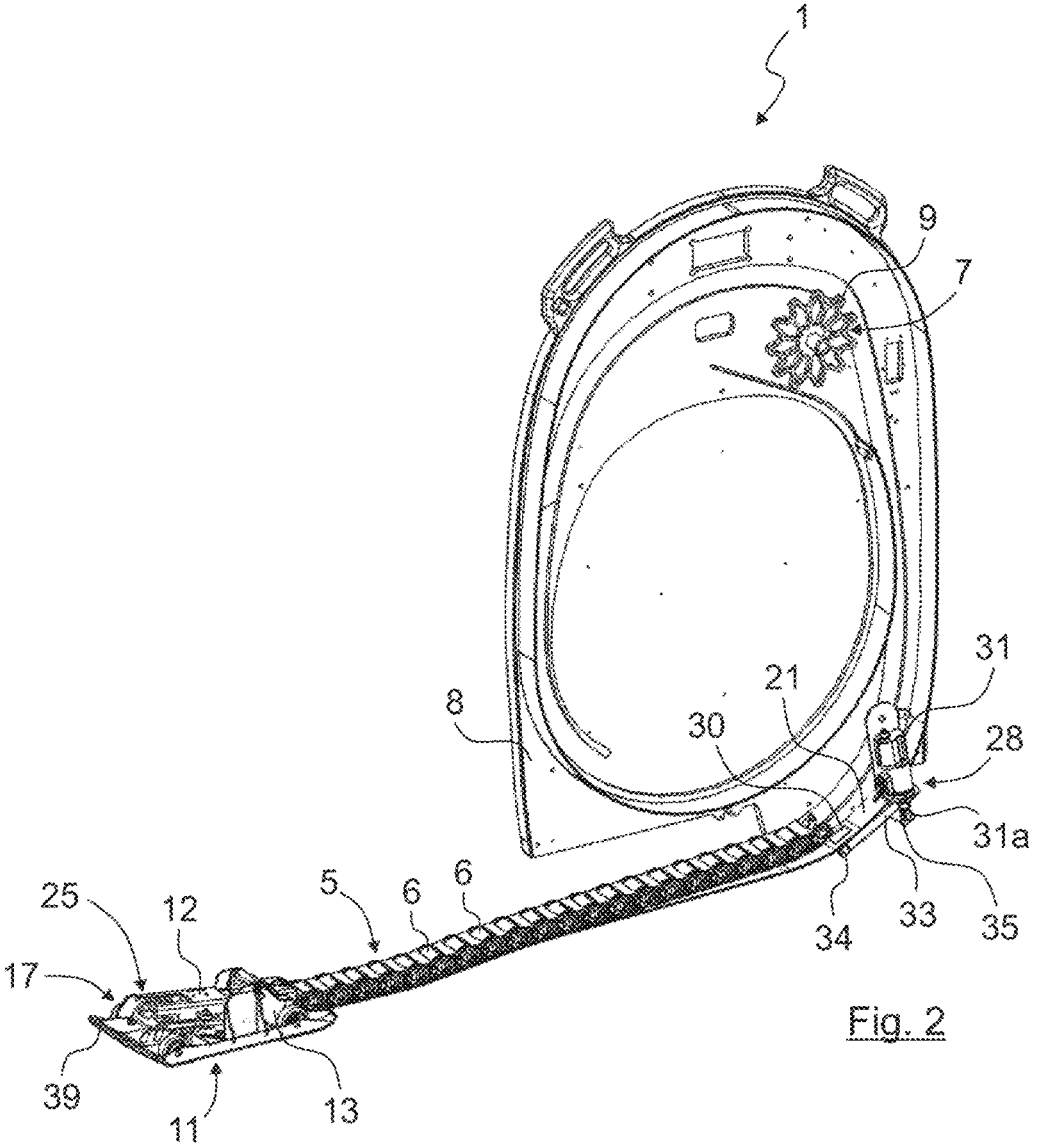
FIG. 2 shows a perspective illustration of a section through the apparatus according to the invention for strapping packaged goods, in a normal position of the guide carriage prior to reaching a deflection point.
Figure 3:
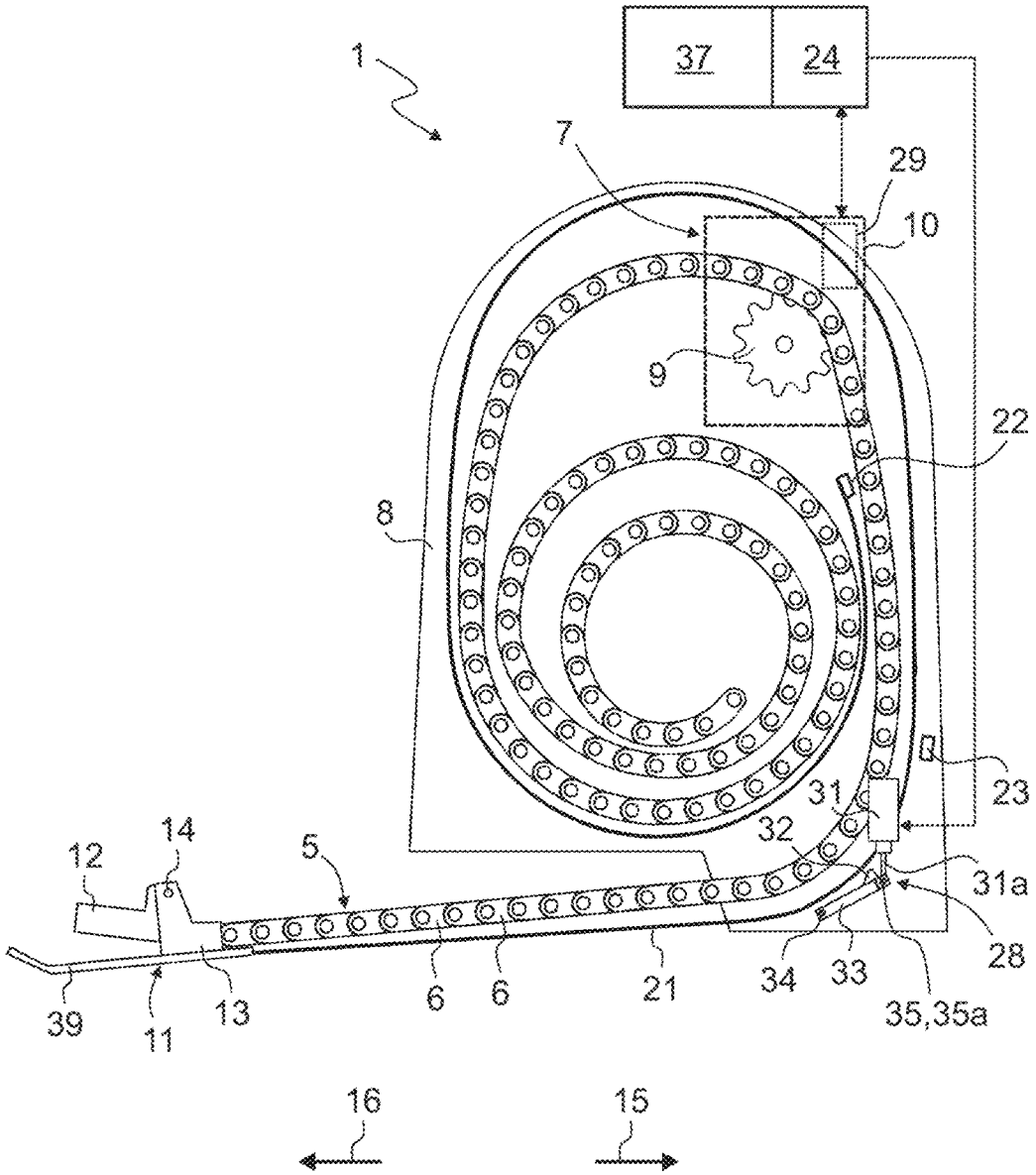
FIG. 3 shows an apparatus according to the invention for strapping in a further sectional illustration, in a normal position prior to reaching the deflection point.
Figure 4:
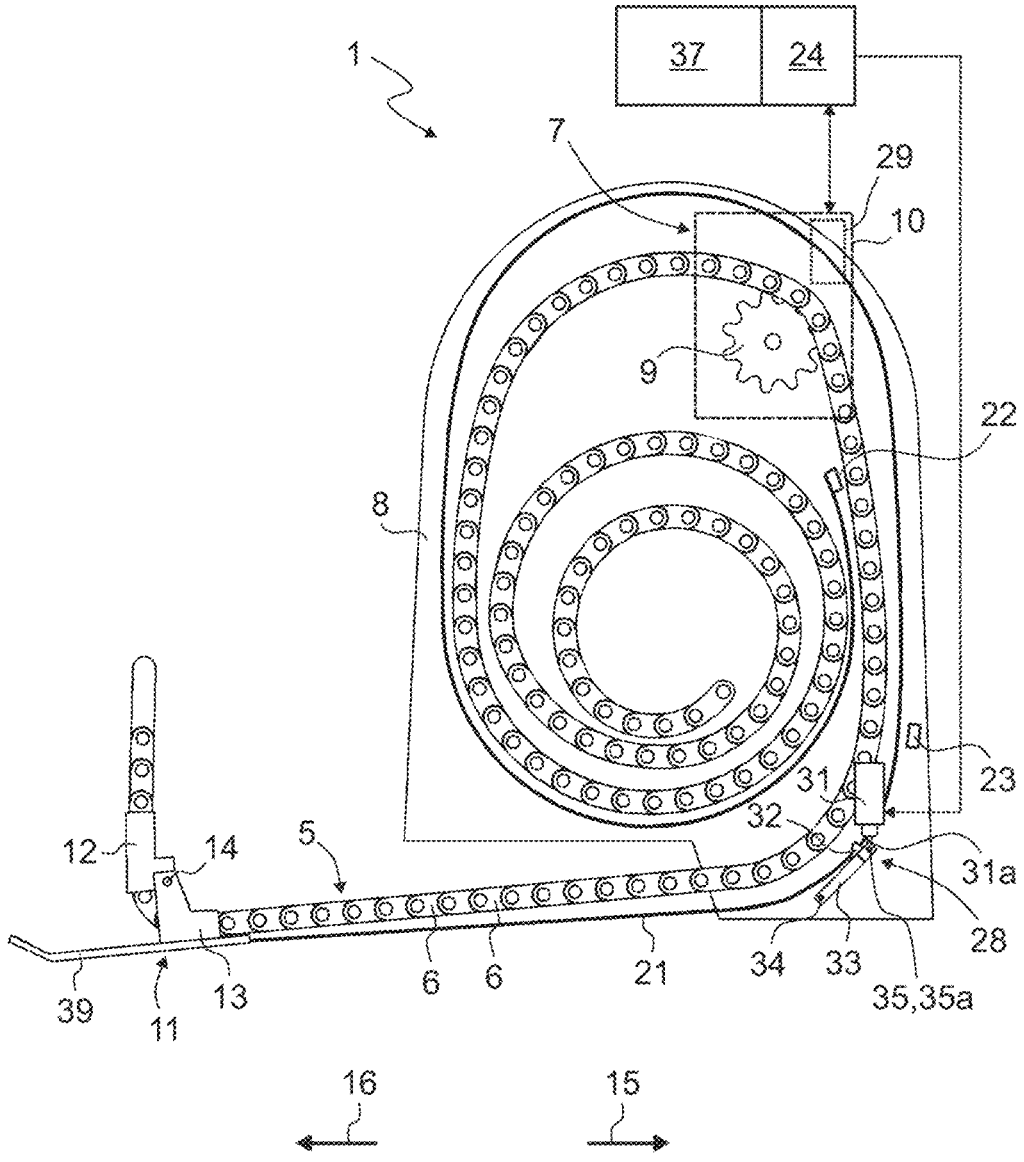
FIG. 4 shows an illustration as per FIG. 3, wherein the guide carriage has reached the deflection point and a deflection unit of the guide carriage is deflected upward by approx. 90 degrees.
Figure 5:
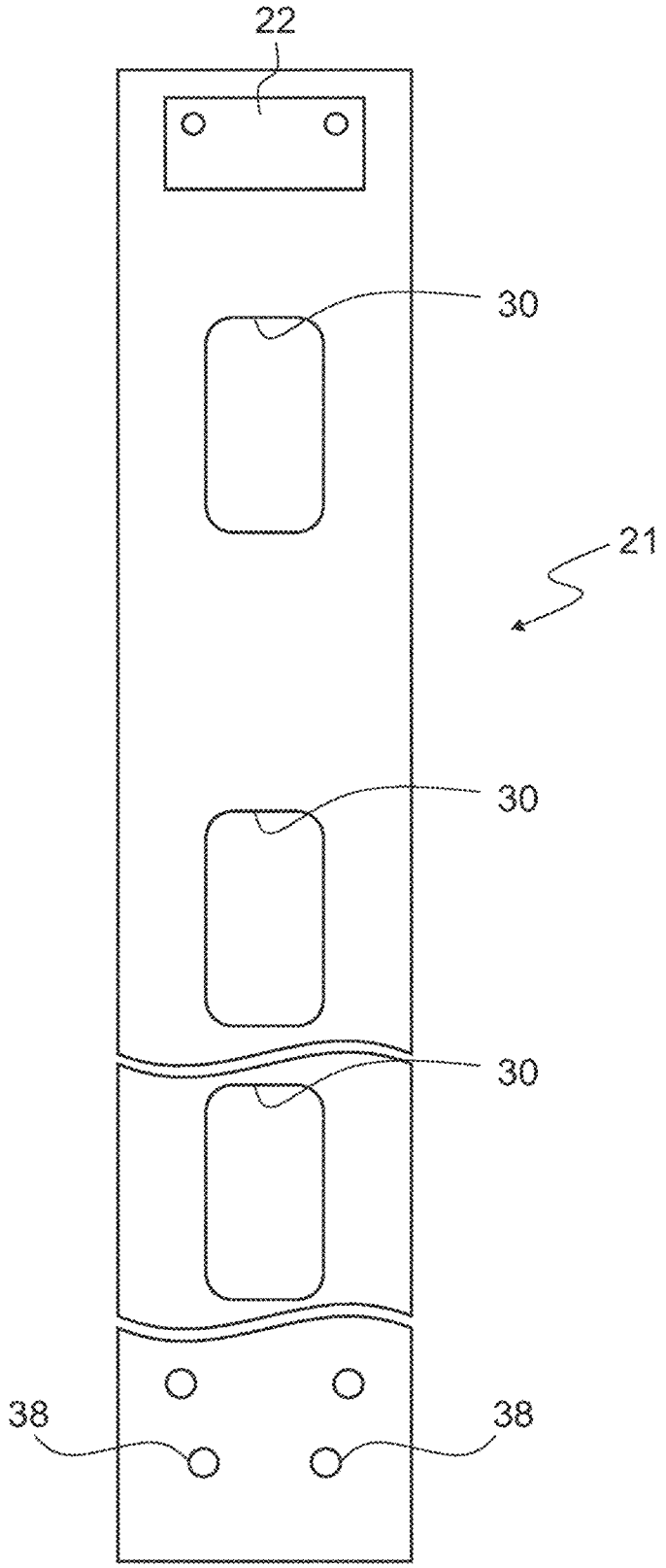
FIG. 5 shows a plan view of a length-limitation band in one potential embodiment.
Figure 6:
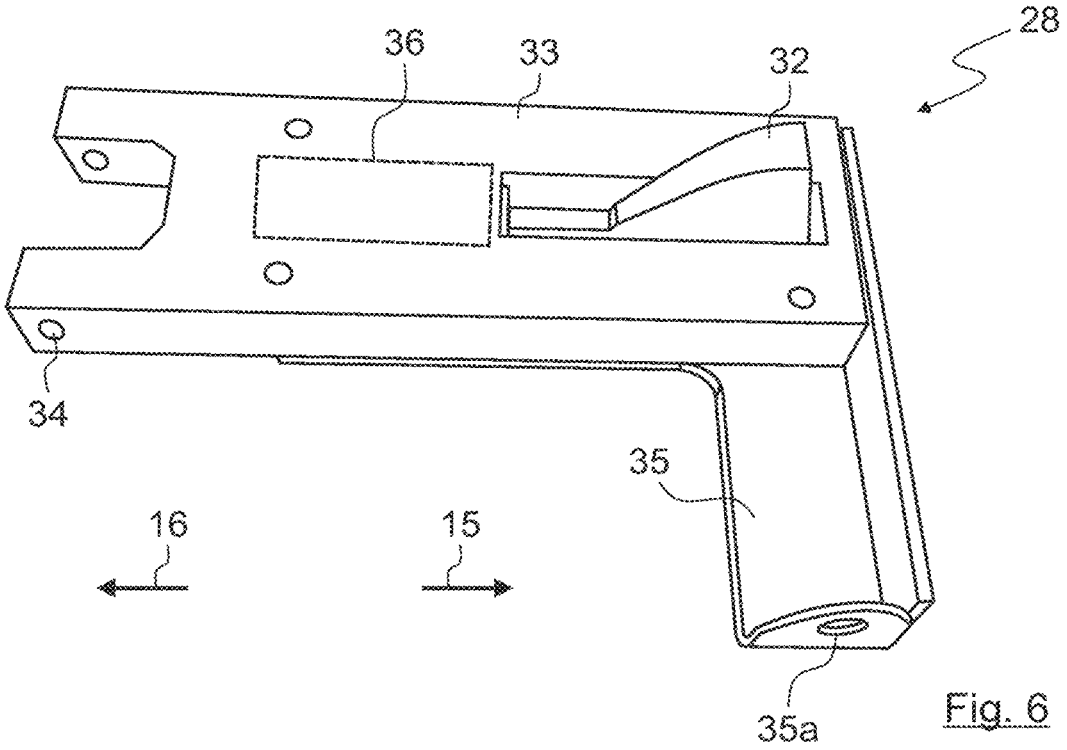
FIG. 6 shows a potential design embodiment of a fixing element of a fixing installation for stopping the extraction movement of the length-limitation band.
Figure 7:
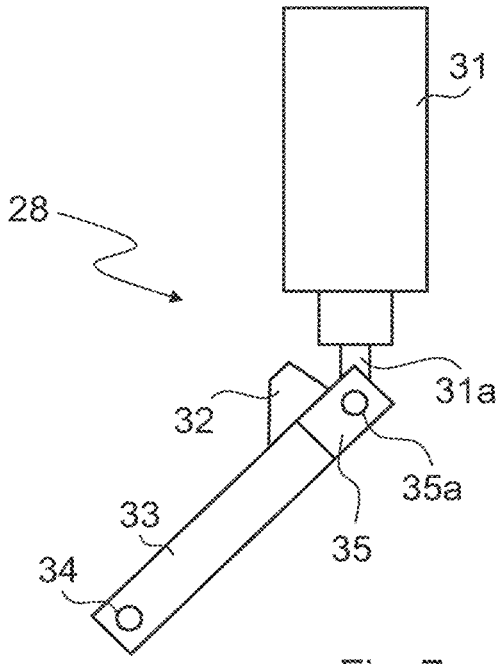
FIG. 7 shows a potential design embodiment of a fixing installation for stopping the extraction movement of a length-limitation band in a design embodiment having a lifting magnet and a latch.

FIGS. 2, 3 and 4 show an apparatus according to the invention for strapping, an adjustment installation and a fixing installation by way of which the apparatus for strapping known from the prior art is further improved being provided in particular in said apparatus according to the invention. Potential advantageous design embodiments of a length-limitation band, or of the fixing installation, are shown in FIGS. 5 to 7.

Identical features of the embodiments of FIG. 1 (prior art) and of FIGS. 2 to 7 are provided with the same reference signs.

FIG. 1 shows an apparatus 1 for strapping packaged goods 2, in particular parcels or items.

As can be seen in FIG. 1, the packaged goods 2 can be placed for example on pallets 3 or similar, and for transportation or for storage be connected to the pallet 3 with the aid of a strapping band 4. The apparatus 1 of FIG. 1 has a band guiding means 5 for guiding the strapping band 4, said band guiding means 5 being in particular configured as a guide chain 5. The band guiding means 5 is preferably configured as a guide chain but the exemplary embodiment is not limited thereto.

The guide chain 5 preferably has a multiplicity of links 6 which are connected to one another, for example by way of pins not referred to in more detail.

The guide chain 5, or the links 6 thereof, is/are preferably configured from plastics material.

Provided is a conveying installation 7 for deploying and retracting the guide chain 5. It is provided in the exemplary embodiment here that the conveying installation 7 engages in the guide chain 5 in order for the latter to be deployed from a housing 8 of the apparatus 1 or retracted into said housing 8.

A supply roll (not illustrated) for the strapping band 4 can also be established on the housing 8 here. The strapping band 4 can preferably be established on a front end of the guide chain 5 such that the strapping band 4 can be deployed by the guide chain 5.

The conveying installation 7, for retracting and deploying the band guiding means 5, preferably has a gear wheel 9 which by way of the teeth thereof engages in the guide chain 5, or the links 6. It can be provided here that the gear wheel 9 by way of the teeth thereof engages in transverse webs of the links 6 that run transversely to the deployment movement of the guide chain 5.

Alternatively, the gear wheel 9, or the conveying installation 7, can also operate the guide chain 5 in another manner in order for the latter to be retracted and deployed.

The conveying installation 7 can be driven by hand or, as is preferably provided in the exemplary embodiments as per FIGS. 2 to 7, by an electric motor 10. The electric motor 10 is indicated by dashed lines in FIGS. 3 and 4.

The retraction and deployment movement of the guide chain 5 can be generated by the electric motor 10, or by a crank.

As can be seen from FIG. 1, the apparatus has a guide carriage 11 which preferably has a deflection unit 12 and a thrust part 13. The guide carriage 11 in FIG. 1 (and also in FIG. 4) is deployed up to a nominal deployment length, or up to a deflection point.

The guide carriage 11 in FIG. 1 (and in FIG. 4) is illustrated in the deflection position thereof in which the deflection unit 12 in relation to the normal position thereof is pivoted by approximately 90 degrees about the pivot axle 14, or a pin. The pivot axle 14 forms the pivot point for the pivoting movement of the deflection unit 12 and to this end is disposed transversely to the direction of the retraction movement (arrow identified by the reference sign 15) and to the direction of the deployment movement (arrow identified by the reference sign 16). The pivot axle 14 forms a form-fitting and rotatable connection between the deflection unit 12 of the guide carriage 11 and the thrust part 13 of the latter.

The guide chain 5 by the deflection unit 12 is deflected in such a manner that said guide chain 5, proceeding from the floor on which the apparatus 1 is placed, is deflected upward, as is illustrated in FIG. 1 and also in FIG. 4.

The configuration of the guide carriage 11, in particular having the deflection unit 12 and/or having the thrust part 13, as is illustrated in FIG. 1, has proven suitable. However, in terms of the fundamental functional mode of the present invention any other type of deflection of the guide chain 5 at the deflection point can also be provided.

In the exemplary embodiment it is provided that the guide carriage 11, conjointly with the guide chain 5, by the nominal deployment length is deployed up to the deflection point and the guide chain 5 at the deflection point is correspondingly deflected by the deflection unit 12.

The guide carriage 11 here is deployed by the guide chain 5 which is correspondingly driven by way of the conveying installation 7. The guide carriage 11 and the guide chain 5 here are guided below the packaged goods 2, in the exemplary embodiment also below the pallet 3.

The nominal deployment length in the exemplary embodiment is sized in such a manner that the deflection point is situated at a location where the guide carriage 11 exits from below the pallet 3 again. This is correspondingly illustrated in FIG. 1.

A clamping installation 17 by way of which the strapping band 4 is fixed to the guide chain 5 prior to the beginning of the strapping procedure is disposed on a front end of the guide chain 5 in the exemplary embodiment. The clamping installation 17 can be embodied as a self-clamping eccentric pin, for example, the latter being rotatably mounted by way of a pin 18. Moreover, the guide chain 5 on this end can have a release cam 19 fixedly connected to said guide chain 5, as well as a slot 20 disposed in the guide chain 5. The release cam 19 and the slot 20 serve for releasably connecting the guide carriage 11 to the guide chain 5.

It is to be pointed out that the manner of fastening the strapping band 4, or the clamping installation 17, and also the manner of connecting the guide carriage 11 to the guide chain 5, represents only one of a plurality of potential design embodiments, the exemplary embodiment, or the invention, not being limited thereto. Nevertheless, the design embodiment described above and hereunder has proven particularly advantageous.

Furthermore shown in FIG. 1 is a length-limitation band 21 which by one end is preferably fastened to the thrust part 13 of the guide carriage 11 and by another end, by way of a terminal detent 22 fastened to the length-limitation band 21, is able to be fixed to the apparatus 1, or to a fixed part of the housing 8. The distance able to be travelled by the guide carriage 11 in the apparatus 1 of the prior art illustrated in FIG. 1 can be adjusted with the aid of the terminal detent 22 and a counter detent 23 that is movable in FIG. 1.

Likewise provided in the apparatus 1 according to the invention, as is illustrated in FIGS. 2 to 7, is a length-limitation band 21. The apparatus 1 according to the invention, as is illustrated in FIGS. 2 to 7, however discloses an adjustment of the length-limitation band 21 that deviates from the illustration in FIG. 1. This will be illustrated in more detail hereunder by means of FIGS. 2 to 7.

It is to be pointed out that it can optionally be provided also according to FIGS. 2 to 7 that the length-limitation band possesses a terminal detent 22, it being avoided by the latter in particular that the length-limitation band 21 is completely extracted from the apparatus 1, or in the housing 8. A counter detent 23 which interacts with the terminal detent 22 in such a manner that a complete extraction is avoided can then also be provided in this context. The counter detent 23 in this instance is however preferably no longer movably connected, but fixedly connected, preferably to the housing 8, in particular to a plate of the housing 8. This is schematically illustrated in FIGS. 3 and 4.

In the exemplary embodiments as per FIGS. 1 to 7 it is provided that the length-limitation band 21 is connected to the guide carriage 11 and is able to be extracted by the guide carriage 11. Deviating from FIG. 1, an adjustment installation 24 for adjusting the nominal deployment length of the guide carriage 11 up to the deflection point is however provided in FIGS. 2 to 7. The functional mode of the adjustment installation 24 and the design embodiment of the latter will be illustrated in more detail hereunder by means of FIGS. 2 to 7.

First, a fundamental functional principle of the apparatus according to the invention is to be set forth again by means of FIG. 1.

However, it is to be once again pointed out that the explanation by means of FIG. 1 serves only for illustrating a functional principle of the apparatus 1 according to the invention, the latter having been proven suitable; the implementation of the solution according to the invention is however not limited to the specific design embodiment illustrated in FIG. 1.

To this extent, all features illustrated in FIG. 1 are to be considered optional.

As can be seen from FIG. 1, the guide chain 5 by way of a special locking mechanism 25 can be releasably connected to the guide carriage 11 as follows.

The locking mechanism 25 has a rotatably mounted lever 26, the latter being rotatably mounted by way of a pin (not provided with a reference sign).

The coupled, forward-directed, deployment movement 16 of the guide chain 5 by the connected guide carriage 11 according to the embodiment illustrated in FIG. 1 takes place until the guide carriage 11, for example with the aid of the length-limitation band 21, is stopped in its position, i.e. the terminal detent 22 impacts the movable counter detent 23. The distance travelled by the guide carriage 11 here can be variably adjusted by way of the terminal detent 22.

The guide chain 5, and the deflection unit 12 of the guide carriage 11 that at this point in time is locked to the guide chain 5, with the aid of the gear wheel 9 however continue to be conveyed in the direction of the deployment movement 16, as a result of which the deflection unit 12 in relation to the previous position is deflected by approximately 90 degrees until said deflection unit 12 bears on a detent 13*a* attached to the thrust part 13. In the normal position of the deflection unit 12 (in which the latter has not yet been pivoted by 90 degrees) a support block 27 prevents a locking pin (not illustrated) connected to the guide carriage 11 from popping out of the slot 20 in that said locking pin on the end face of the latter bears on the support block 27. By pivoting the deflection unit 12, this locking pin is released with the aid of the lever 26, as a result of which the connection between the deflection unit 12 and the rigid-spine guide chain 5 is released. At the same time, the locking pin that has popped out, or the lever, locks the deflection unit 12 in the substantially vertical position of the latter.

The previously described design embodiment is also illustrated in detail in EP 1 053 941 B1, reference thereto being made herewith. The aforementioned design embodiment is optional in the context of the present invention but may be advantageous.

The band guiding means embodied as the guide chain 5 upon passing through the deflection unit 12 in a substantially perpendicular manner in relation to the floor continues to be conveyed upward along a lateral wall of the packaged goods 2 to be packed. Tilting of the guide chain 5 away from the packaged goods 2 to be packed is suppressed as a result of the embodiment of said guide chain 5 with a rigid spine.

Furthermore, the strapping band 4 preferably guided on the spine of the guide chain 5 keeps the latter pretensioned such that tilting toward the packaged goods 2 to be packed is also prevented. The tension of the strapping band 4 can however be released, for example as a result of a brief interruption of the deployment movement, so that the guide chain 5, when the latter protrudes to a certain extent beyond the upper edge of the packaged goods 2 to be packed, can then be folded onto the parcel 2 as desired. From there, the guide chain 5 on the packaged goods 2 to be packed is conveyed back in the direction toward the apparatus 1. The aforementioned motion sequence has proven advantageous but is optional in order for the present invention to be implemented.

In this way, the user, without having to move in practical terms, can now grip the strapping band 4. The clamping installation 17 is released when the guide chain 5 runs back, this preferably as a result of firmly holding the strapping band 4. The guide chain 5 can be conveyed back into the apparatus again, wherein the deflection unit 12 in the return movement (arrow 15) with the aid of the release cam 19 and the lever 26 is again connected to the free end of the guide chain 5. The locking mechanism of the deflection unit 12 is simultaneously released such that the latter can be pivoted back to the normal position thereof again. To this end, the release cam 19 pushes the front bent end of the lever 26 away from the rigid-spine guide chain 5, as a result of which the locking pin situated at the other end of the lever 26 is simultaneously inserted back through the slot 20 of the guide chain 5 again and the desired coupling is achieved. Finally, the guide chain 5 entrains the re-coupled guide carriage 11 back into the apparatus 1.

Further details pertaining to the functional principle of the apparatus from the prior art can be derived from patent application EP 1 053 941 B1, reference being explicitly made thereto herewith.

It is to be pointed out once again that the design embodiment illustrated in the context of FIG. 1, in particular also in terms of the locking mechanism 25 and of the design embodiment having the pin 18, or the release cam 19, and the slot 20 are optional designs which may however prove advantageous.

The present invention henceforth differs from the prior art in that the nominal deployment length of the guide carriage 11 is adjustable by means of the adjustment installation 24, and the adjustment installation 24 is specified for determining an actual deployment length of the guide carriage 11, preferably continuously while the guide carriage 11 is deployed, and a fixing installation 28 which stops the extraction movement of the length-limitation band 21 is controlled by the adjustment installation 24 as a function of the nominal deployment length. This is correspondingly illustrated in FIGS. 2 to 7. Deviating from the illustration according to FIG. 1, the variable deployment length of the length-limitation band 21 is thus no longer adjusted by the terminal detent 22 and the counter detent 23, the latter being able to be fastened in a variable manner on the housing 8, but by the adjustment installation 24, or the correspondingly controlled fixing installation 28, this being illustrated in more detail hereunder.

In the exemplary embodiment as per FIGS. 2 to 7 it is preferably provided that the conveying installation 7 comprises the electric motor 10 which, preferably by way of the illustrated gear wheel 9, retracts and deploys the guide chain 5. The adjustment installation 24 here is specified in such a manner that the latter by means of the data of the electric motor 10, in particular by means of the revolutions of the electric motor 10, electronically determines the actual deployment length of the guide carriage 11, wherein the adjustment installation 24 here also determines partial revolutions of the electric motor 10.

The electric motor 10 in the exemplary embodiment has an incremental encoder 27 with the aid of which the revolutions of the electric motor 10, or the angular position and thus the actual deployment length of the guide carriage 11, are/is preferably determined by means of the deployment length of the guide chain 5.

The adjustment installation 24 is preferably specified in such a manner that the conveying installation 7, upon switching on and/or if required, can be actuated in such a manner that the conveying installation 7 repositions the guide carriage 11 to a reference position. It is preferably provided here that the conveying installation 7 retracts the guide carriage 11 into the apparatus 1, or the housing 8, up to a detent. The maximum retracted position here can represent the reference position. However, it is preferable for the reference position to deviate from the maximum retracted position of the guide carriage 11, i.e. that the guide carriage 11 from the maximum retracted position is deployed again somewhat in the direction of the arrow 16, and the correspondingly approached position in this instance is the reference position. The incremental encoder 29 can then be calibrated by means of the reference position, for example.

It is provided in the exemplary embodiment that the fixing installation 28 is configured for fixing the length-limitation band 21 in a form-fitting and/or force-fitting manner (for example by clamping jaws), or for correspondingly acting on said length-limitation band 21.

A form-fitting connection between the fixing installation 28 and the length-limitation band 21 is illustrated in the exemplary embodiment. To this end, the length-limitation band 21 has detent elements 30 which are disposed in succession in the longitudinal direction of the length-limitation band 21.

The detent elements 30 are illustrated in an exemplary manner in FIG. 5. The detent elements 30 preferably extend at least along one portion of the length-limitation band 21. The detent elements 30 preferably extend at a regular pitch along the portion such that the fixing or stopping of the length-limitation band 21 can take place at a regular pitch of preferably 5 to 15 cm, particularly preferably of 10 cm.

In the exemplary embodiment it is provided that the detent elements 30 are configured as recesses, in particular in the form of slots, in the length-limitation band 21. Alternatively, it can also be provided that the detent elements 30 are configured as protrusions so as to establish a form-fitting connection with a correspondingly designed element of the fixing installation 28.

As can be seen in particular from FIGS. 3, 4, 6 and 7, it is provided in the exemplary embodiment that the fixing installation 28 has an actuating unit 31 which for delimiting the extraction movement of the length-limitation band 21 brings a fixing element 32 to engage in a form-fitting manner with one of the detent elements of the length-limitation band 21 (FIG. 5), said detent elements being configured as recesses 30.

The actuating installation 31 in the exemplary embodiment is configured as a lifting magnet, and the fixing element 32 is configured as a latch. The latch 32 here is disposed in a receptacle 33 which can be configured in the manner of a flat housing. The receptacle 33, preferably by way of a rotatable fastening axle 34, is established on a fixed part of the housing 8, preferably between two fixed plates of the housing 8. The receptacle 33 here is pivotable about the fastening axle 34 when the lifting magnet 31 is correspondingly operated.

The receptacle 33 further has a collar 35 on which the lifting magnet 31 can engage in a corresponding manner. This is correspondingly illustrated in FIGS. 6 and 7. The lifting magnet 31 can thus pivot, in particular lift and lower, the receptacle 33, and thus also the latch 32, about the fastening axle 34 such that the latch 32 if required can be brought to engage with one of the recesses 30 of the length-limitation band 21. The controlling of the lifting magnet 31, or of the fixing installation 28, here takes place by means of the data of the adjustment installation 34, in particular by means of the determined actual deployment length of the guide carriage 11 and of the envisaged nominal deployment length of the guide carriage 11.

It is preferably provided in the exemplary embodiment that the fixing element, in particular the latch 32, interacts with a damping element 36 so as to stop in a damped manner the extraction movement of the length-limitation band 21. The damping element 36 is illustrated by dashed lines in FIG. 6. The damping element 36 has the effect that the latch 32, when the latter is impinged with a force in the direction toward the damping element 36—this being the result of the latch 32 being brought to engage with the recess 30—as a result of the damping element 36 stops the length-limitation band 21 not in an abrupt manner but rather in a damped manner, this being by virtue of the evasive movement of the latch 32 made possible by said damping element 36. The damping element 36 can be a spring, for example, but preferably an elastic element, for example a rubber element, or a correspondingly suitable elastomer.

The latch 32, or the receptacle 33 in which the latch 32 is disposed, and/or the lifting magnet 31 are/is preferably configured in such a manner that the latch 32 in the non-energized state of the lifting magnet 31 as a result of a spring force (not illustrated) locks with one of the recesses 30 of the length-limitation band 21 as soon as one recess 30 is in a position that communicates with the latch 32. It is ensured as a result that the guide carriage 11 in the non-energized state of the lifting magnet 31 is not able to be moved in an arbitrary manner but is fixed, at the latest when the guide carriage 11 is displaced in such a manner that one of the recesses 30 of the length-limitation band 21 is brought into a position that communicates with the latch 32. In the non-energized state of the lifting magnet 31 the guide carriage 11 can thus be displaced at most by the dimension of the pitch.

It is illustrated in FIG. 6 and FIG. 7 that the actuating installation 35 has a bore 35*a*, or an arbitrary fastening point, on which a movable element 31*a* of the lifting magnet 31 can engage in order for the receptacle 33 to be moved.

It is preferably provided in a manner not illustrated in more detail in the exemplary embodiment that the latch 32 by a spring force is pretensioned in the direction toward the length-limitation band 21. It is preferably provided in the exemplary embodiment that the adjustment installation 24 initiates the fixing installation 28 to correspondingly move the latch 32 in position already just prior to reaching the recess 30 into which the latch 32 is to move. In order to avoid a lot of friction between the latch 32 and the length-limitation band 21 while there is still no recess 30 in position, it can therefore be advantageous for the latch 32, counter to the force of a spring, to be able to yield toward the rear, i.e. away from the length-limitation band 21. It is also achieved as a result of the spring force that the latch 32 penetrates the recess 30 in a particularly reliable manner.

In the exemplary embodiment as per FIGS. 2 to 7 it is provided that the conveying installation 7 by a control installation 37, the latter to this end obtaining corresponding data from the adjustment installation 24, is actuated in such a manner that the deployment speed of the guide chain 5 in a last portion of the nominal deployment length of the guide carriage 11 prior to reaching the deflection point is reduced in comparison to a deployment speed prior to the last portion of the nominal deployment length. As a result it is possible for the guide carriage 11 to be able to be deployed in a comparatively rapid manner and for the speed of the guide carriage 11 to be reduced, preferably significantly, only if possible just prior to reaching the deflection point. It is preferably furthermore provided that the deployment speed of the guide chain 5 upon reaching the deflection point, i.e. when the deflection unit 12 has deflected the guide chain 5, is increased in comparison to the deployment speed of the guide chain 5 in the last portion of the nominal deployment length of the guide carriage 11 prior to reaching the deflection point. It has been demonstrated that a high deployment speed of the guide chain 5, in particular after the deflection point, can noticeably reduce the entire duration of the strapping procedure.

It can be provided that the adjustment installation 24 is configured as part of the control installation 37. The apparatus 1 according to the invention preferably has a display, not illustrated in more detail, in which a plurality of nominal deployment lengths are preset and can be selected by the user. It is furthermore preferably indicated in the display whether the length-limitation band 21, or the guide carriage 11, is locked, unlocked or in an undefined state.

A length-limitation band 21 is illustrated in an exemplary manner in FIG. 5, wherein a terminal detent 22 is also optionally provided so that the length-limitation band 21 preferably cannot be completely extracted from the apparatus 1, or from the housing 8. Fastening points 38 which serve for establishing the length-limitation band 21 on the guide carriage 11 are furthermore illustrated on that end of the length-limitation band 21 that faces away from the terminal detent 22 in FIG. 5.

An adjustment installation 24 and a control installation 37 which interact with the electric motor 10, or the incremental encoder 29, as well as the fixing installation 28 are illustrated in only an exemplary manner in FIGS. 3 and 4.

A skid part 39 at the front end of the guide carriage 11 is illustrated in FIGS. 2 to 4, the end portion of said skid part 39 pointing away from the floor so that the guide carriage 11 can compensate for any minor unevenness of the floor, such as the transverse timbers of the pallet, in a particularly simple manner. The skid part 39 can in principle also be designed in such a manner that said skid part 39 has an upward-pointing end portion at both ends so that any unevenness can be compensated for in both directions of movement of the guide carriage 11 (retraction movement 15 and deployment movement 16).

A particularly advantageous method for controlling the apparatus illustrated in FIGS. 2 to 7 is derived from claim 16.

The invention claimed is:

1. An apparatus for strapping packaged goods with a strapping band, comprising a band guide for guiding the strapping band, a conveying assembly for deploying and retracting the band guide, a guide carriage, which conjointly with the band guide by a nominal deployment length is deployable up to a deflection point, a length-limitation band which is connected to the guide carriage and extractable by the guide carriage, and an adjustment installation for adjusting the nominal deployment length of the guide carriage up to the deflection point, wherein the guide carriage has a deflection unit which is capable of deflecting the band guide at the deflection point, and wherein the adjustment installation is configured to determine an actual deployment length of the guide carriage and, as a function of the nominal deployment length of the guide carriage, is configured to control a fixing assembly which stops an extraction movement of the length-limitation band.

2. The apparatus as claimed in claim 1, wherein the conveying assembly comprises an electric motor, and wherein the adjustment installation is configured to determine the actual deployment length of the guide carriage electronically based on a number of revolutions of the electric motor.

3. The apparatus as claimed in claim 2, wherein the electric motor comprises an encoder.

4. The apparatus as claimed in claim 1, wherein the adjustment installation is configured to actuate the conveying assembly in such a manner that the conveying assembly is able to reposition the guide carriage to a reference position.

5. The apparatus as claimed in claim 1, wherein the fixing assembly is configured to act on the length-limitation band in at least one of a form fitting manner and a force fitting manner.

6. The apparatus as claimed in claim 1, wherein the length-limitation band has a plurality of detent elements disposed in succession in the longitudinal direction of the length-limitation band.

7. The apparatus as claimed in claim 6, wherein a set of detent elements of the plurality of detent elements is disposed at a regular pitch at least along one portion of the length-limitation band.

8. The apparatus as claimed in claim 6, wherein a set of detent elements of the plurality of detent elements is configured in the length-limitation band as at least one of (i) recesses and (ii) protrusions.

9. The apparatus as claimed in claim 6, wherein the fixing assembly comprises an actuator that is configured to limit the extraction movement of the length-limitation band by causing a fixing element to engage in a form-fitting manner with one of the detent elements of the plurality of detent elements of the length-limitation band.

10. The apparatus as claimed in claim 9, wherein the fixing element interacts with a damping element, so as to stop the extraction movement of the length-limitation band in a damped manner.

11. The apparatus as claimed in claim 9, wherein the adjustment installation is configured to detect a position of at least one of (i) the fixing element and (ii) the actuator.

12. The apparatus as claimed in claim 9, wherein, when the actuator is in a non-energized state, the fixing element is locked to one of the detent elements of the plurality of detent elements by a spring force.

13. The apparatus as claimed in claim 9, wherein at least one of (i) the actuator is configured as a lifting magnet, and (ii) the fixing element is configured as a latch.

14. The apparatus as claimed in claim 1, wherein the band guide comprises a guide chain, and wherein the conveying assembly includes at least one gear wheel that engages the guide chain for retracting and deploying the guide chain.

15. The apparatus as claimed in claim 1, further comprising a controller, said controller configured to actuate the conveying assembly such that at least one of (i) a deployment speed of the band guide in a last portion of the nominal deployment length of the guide carriage prior to reaching the deflection point is reduced in comparison to a deployment speed prior to the last portion of the nominal deployment length and (ii) the deployment speed of the band guide upon reaching the deflection point is increased in comparison to the deployment speed of the band guide gin the last portion of the nominal deployment length of the guide carriage prior to reaching the deflection point.

16. A method for strapping packaged goods with a strapping band-established on a band guide, wherein the band guide is configured to be deployed by a conveying assembly, wherein a guide carriage, releasably connected to the band guide, conjointly with the band guide is configured to be guided below the packaged goods and deployed up to a deflection point, wherein a length-limitation band coupled to the guide carriage is configured to be extracted by the guide carriage, wherein a nominal deployment length of the guide carriage up to the deflection point is adjustable by adjusting an extractable length of the length-limitation band, the method comprising:

determining an actual deployment length of the guide carriage during deployment of the guide carriage; and stopping an extraction movement of the length-limitation band upon reaching the nominal deployment length of the guide carriage;

wherein at least one of (i) a deployment speed of the band guide in a last portion of the nominal deployment length of the guide carriage prior to reaching the deflection point is reduced in comparison to a deployment speed prior to reaching the last portion of the nominal deployment length, and (ii) the deployment speed of the band guide upon reaching the deflection point is increased in comparison to the deployment speed of the band guide in the last portion of the nominal deployment length of the guide carriage.

17. A computer program product having a program code that, when executed on a controller of an apparatus for strapping packaged goods with a strapping band, the apparatus comprising (a) a band guide for guiding the strapping band, (b) a conveying assembly for deploying and retracting the band guide, (c) a guide carriage, which conjointly with the band guide by a nominal deployment length is deployable up to a deflection point, (d) a length-limitation band which is connected to the guide carriage and extractable by the guide carriage, and (e) an adjustment installation for adjusting the nominal deployment length of the guide carriage up to the deflection point, wherein the guide carriage has a deflection unit which is capable of deflecting the band guide at the deflection point, and wherein the adjustment installation is configured to determine an actual deployment length of the guide carriage and, as a function of the nominal deployment length of the guide carriage, is further configured to control a fixing assembly which stops an extraction movement of the length-limitation band, causes the adjustment installation to determine the actual deployment length of the guide carriage during deployment of the guide carriage; and causes the extraction movement of the length-limitation band to be stopped upon reaching the nominal deployment length of the guide carriage;

wherein at least one of (i) a deployment speed of the band guide in a last portion of the nominal deployment length of the guide carriage prior to reaching the deflection point is reduced in comparison to a deployment speed prior to reaching the last portion of the nominal deployment length, and (ii) the deployment speed of the band guide upon reaching the deflection point is increased in comparison to the deployment speed of the band guide in the last portion of the nominal deployment length of the guide carriage.

* * * * *